US010657887B2

(12) United States Patent
Lu et al.

(10) Patent No.: US 10,657,887 B2
(45) Date of Patent: May 19, 2020

(54) PROTECTION CIRCUIT AND METHOD, PIXEL CIRCUIT, AND DISPLAY DEVICE

(71) Applicant: BOE TECHNOLOGY GROUP CO., LTD., Beijing (CN)

(72) Inventors: Pengcheng Lu, Beijing (CN); Xiaochuan Chen, Beijing (CN); Shengji Yang, Beijing (CN); Lei Wang, Beijing (CN); Dongni Liu, Beijing (CN); Jie Fu, Beijing (CN); Li Xiao, Beijing (CN); Han Yue, Beijing (CN); Jian Gao, Beijing (CN); Changfeng Li, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 21 days.

(21) Appl. No.: 15/778,047

(22) PCT Filed: Sep. 30, 2017

(86) PCT No.: PCT/CN2017/104718
§ 371 (c)(1),
(2) Date: May 22, 2018

(87) PCT Pub. No.: WO2018/126748
PCT Pub. Date: Jul. 12, 2018

(65) Prior Publication Data

US 2019/0043422 A1 Feb. 7, 2019

(30) Foreign Application Priority Data

Jan. 3, 2017 (CN) ..... 2017 1 0002572

(51) Int. Cl.
*G09G 3/3258* (2016.01)
*G09G 3/3233* (2016.01)
(Continued)

(52) U.S. Cl.
CPC ..... *G09G 3/3233* (2013.01); *G09G 3/006* (2013.01); *G09G 3/3258* (2013.01);
(Continued)

(58) Field of Classification Search
CPC .... G09G 3/3258; G09G 3/3291; G09G 3/006; G09G 3/3233; G09G 2310/0291;
(Continued)

(56) References Cited

U.S. PATENT DOCUMENTS

2005/0270059 A1 12/2005 Ando
2006/0061525 A1 3/2006 Kim et al.
(Continued)

FOREIGN PATENT DOCUMENTS

CN 1790467 A 6/2006
CN 201035270 Y 3/2008
(Continued)

OTHER PUBLICATIONS

International Search Report from PCT Application No. PCT/CN2017/104718 dated Jan. 4, 2018 (5 pages).
(Continued)

*Primary Examiner* — Dennis P Joseph
(74) *Attorney, Agent, or Firm* — Dave Law Group LLC; Raj S. Dave

(57) ABSTRACT

Embodiments of the present disclosure provide a protection circuit and method, a pixel circuit, and a display device. The protection circuit comprises a determination circuit, a first coupling circuit, a first terminal and a second terminal. The determination circuit is coupled to the first terminal and the first coupling circuit, and is configured to determine whether the voltage at the first terminal of the protection circuit belongs to one of a first predetermined range and a second predetermined range. The first coupling circuit is coupled to the first terminal, the second terminal and the determination
(Continued)

circuit, and is configured to: couple the first terminal to the second terminal in response to the voltage at the first terminal belonging to the first predetermined range; and decouple the first terminal from the second terminal in response to the voltage at the first terminal belonging to the second predetermined range.

15 Claims, 8 Drawing Sheets

(51) Int. Cl.
*G09G 3/00* (2006.01)
*G09G 3/3291* (2016.01)

(52) U.S. Cl.
CPC ... *G09G 3/3291* (2013.01); *G09G 2300/0819* (2013.01); *G09G 2310/0291* (2013.01); *G09G 2320/0295* (2013.01); *G09G 2330/04* (2013.01); *G09G 2330/10* (2013.01); *G09G 2330/12* (2013.01)

(58) Field of Classification Search
CPC ..... G09G 2330/12; G09G 2330/04; G09G 2330/10; G09G 2320/0295
See application file for complete search history.

(56) References Cited

U.S. PATENT DOCUMENTS

2006/0118699 A1 6/2006 Osame et al.
2010/0302692 A1 12/2010 Groenewold
2015/0015137 A1* 1/2015 Kang ..... H05B 33/0896 313/504
2015/0339975 A1* 11/2015 Liu ..... G09G 5/10 345/204
2016/0307503 A1 10/2016 Song et al.

FOREIGN PATENT DOCUMENTS

CN 101276528 A 10/2008
CN 101916550 A 12/2010
CN 201689649 U 12/2010
CN 102449908 A 5/2012
CN 104282264 A 1/2015
CN 204632314 U 9/2015
CN 106486041 A 3/2017
CN 106531071 A 3/2017
CN 106531080 A 3/2017
CN 206301579 U 7/2017
CN 206301580 U 7/2017

OTHER PUBLICATIONS

Written Opinion from PCT Application No. PCT/CN2017/104718 dated Jan. 4, 2018 (4 pages).
Office Action from Chinese Application No. 201710002572.7 dated Nov. 2, 2018 (7 pages).

* cited by examiner

PROTECTION CIRCUIT AND METHOD, PIXEL CIRCUIT, AND DISPLAY DEVICE

CROSS-REFERENCE TO RELATED APPLICATION

This application claims the benefit and priority of Chinese Patent Application No. 201710002572.7 filed on Jan. 3, 2017, the entire content of which is incorporated by reference herein.

FIELD

The present disclosure relates to the field of display, and in particular, to a protection circuit and method, a pixel circuit, and a display device.

BACKGROUND

Organic light emitting diode (OLED) is one of the current focuses in the field of display research. Compared with a liquid crystal display (LCD), an OLED display has the advantages of low energy consumption, low production cost, self-luminescence, wide viewing angle, and fast response speed. Currently, OLED displays have begun to replace traditional LCD displays in various display fields such as mobile phones, personal digital assistants (PDAs), and digital cameras.

Unlike a pixel unit in an LCD display that uses a stable voltage to control luminance, an OLED in an OLED display is driven by current and requires a steady current to control light emission. Therefore, when the OLED operates, there may be a large current. Once the OLED in a certain pixel unit, or the driving circuit of the OLED fails, especially suffers from a short circuit, a large current will flow to an undesired position or device. A plurality of pixel units in the periphery of a defective pixel unit may be affected. Therefore, there is a need to provide a protection circuit in a display, especially an OLED display.

BRIEF DESCRIPTION

Embodiments of the present disclosure provide a protection circuit and method, a pixel circuit, and a display device.

A first aspect of the embodiments of the present disclosure provides a protection circuit. The protection circuit includes a determination circuit, a first coupling circuit, a first terminal and a second terminal. The determination circuit is coupled to the first terminal and the first coupling circuit, and is configured to determine whether a voltage at the first terminal of the protection circuit belongs to one of a first predetermined range and a second predetermined range. The first coupling circuit is coupled to the first terminal, the second terminal and the determination circuit, and is configured to couple the first terminal to the second terminal in response to the voltage at the first terminal belonging to the first predetermined range; and decouple the first terminal from the second terminal in response to the voltage at the first terminal belonging to the second predetermined range.

In embodiments of the present disclosure, the determination circuit includes an amplifier including a first input terminal, a second input terminal, and an output terminal. The first input terminal of the amplifier is coupled to the first terminal of the protection circuit. The second input terminal of the amplifier is coupled to a reference voltage terminal. The output terminal of the amplifier is coupled to the first coupling circuit.

In embodiments of the present disclosure, the second input terminal of the amplifier is coupled to the reference voltage terminal through a first resistor. The second input terminal of the amplifier is coupled to the output terminal of the amplifier through a second resistor.

In embodiments of the present disclosure, the first coupling circuit includes a first transistor. The control electrode of the first transistor is coupled to the determination circuit, the first electrode of the first transistor is coupled to the first terminal of the protection circuit, and the second electrode of the first transistor is coupled to the second terminal of the protection circuit.

In embodiments of the present disclosure, the protection circuit further includes a second coupling circuit. The second coupling circuit is connected to the first terminal of the protection circuit and is configured to make the voltage at the first terminal of the protection circuit belong to the first predetermined range.

In embodiments of the present disclosure, the second coupling circuit includes a second transistor. The control electrode of the second transistor is coupled to a first control signal terminal. The first electrode of the second transistor is coupled to the first terminal of the protection circuit, and the second electrode of the second transistor is coupled to the second terminal of the protection circuit.

In embodiments of the present disclosure, the protection circuit further includes a voltage detection line. The voltage detection line is configured to couple the first terminal of the protection circuit to a voltage detection device. The second transistor is configured to be turned on in response to the voltage at the first terminal of the protection circuit belonging to a third predetermined range.

In embodiments of the present disclosure, the voltage in the first predetermined range is greater than a first voltage. The voltage in the second predetermined range is less than a second voltage.

In embodiments of the present disclosure, the first voltage is equal to the second voltage.

A second aspect of the present disclosure provides a protection method including: determining whether the voltage at a first terminal belongs to one of a first predetermined range and a second predetermined range; and coupling the first terminal to the second terminal in response to the voltage at the first terminal belonging to the first predetermined range, and decoupling the first terminal from the second terminal in response to the voltage at the first terminal belonging to the second predetermined range.

In embodiments of the present disclosure, the protection method further includes: determining whether the voltage at the first terminal belongs to a third predetermined range; and in response to the voltage at the first terminal belonging to the third predetermined range, making the voltage at the first terminal belong to the first predetermined range.

A third aspect of the present disclosure provides a pixel circuit, including the above-described protection circuit.

In embodiments of the present disclosure, the first terminal of a protection circuit is connected to a light emitting device in a pixel circuit; and the second terminal of the protection circuit is connected to the driving circuit in the pixel circuit.

A fourth aspect of the present disclosure provides a display device including the pixel circuit described above.

Embodiments of the present disclosure provide the protection circuit and method, the pixel circuit, and the display device. They are capable of determining the operating state of the pixel circuit by detecting a voltage. When a fault is found, a current path in the pixel circuit is disconnected.

BRIEF DESCRIPTION OF THE DRAWINGS

In order to more clearly describe the technical solutions of the embodiments of the present disclosure, the drawings of the embodiments will be briefly described below, and it should be appreciated that the drawings described below are only related to some embodiments of the disclosure and are not limitations of the disclosure, wherein.

DETAILED DESCRIPTION

In order to make the technical solutions, and technical effects of the embodiments of the present disclosure more clear, the technical solutions in the embodiments of the present disclosure will be clearly and completely described below in conjunction with the accompanying drawings in the embodiments of the present disclosure. Obviously, the described embodiments are merely some but not all of the embodiments of the present disclosure. All other embodiments obtained by those of ordinary skill in the art based on the embodiments of the present disclosure without making creative efforts shall fall within the protection scope of the present disclosure.

Figure 1:
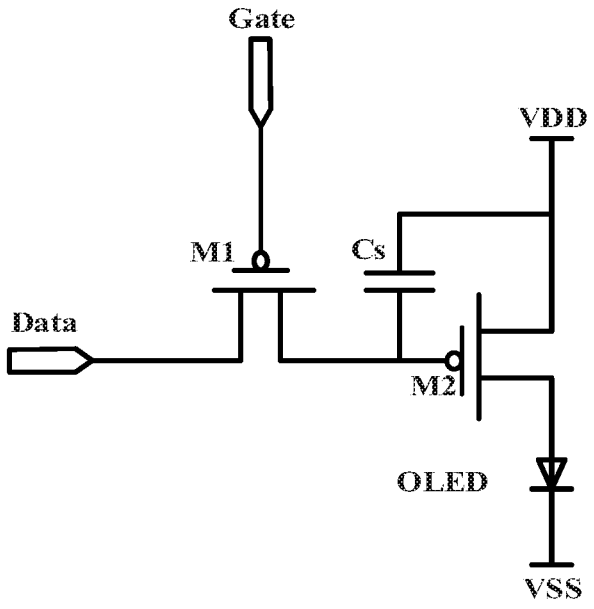
FIG. 1 is an exemplary schematic diagram of a pixel circuit structure.

FIG. 1 is an exemplary schematic diagram of a pixel circuit structure. As shown in FIG. 1, the pixel circuit includes a switching transistor M1, a driving transistor M2, and a storage capacitor Cs. This pixel circuit is also referred to as a two-transistor one-capacitor (2M1C) circuit. When the voltage on a scan line Gate coupled to the pixel circuit is a valid low-level signal, the P-type switching transistor M1 is turned on, and the voltage on a data line Data is written into the storage capacitor Cs. After the scanning is completed, the voltage on the scan line Gate changes to a high level, the P-type switching transistor M1 is turned off, and the voltage stored in the storage capacitor Cs controls the driving transistor M2 to generate a current so as to drive the OLED to emit light. The pixel circuit is further coupled to a first power source VDD and a second power source VSS. The first power source VDD provides, for example, a positive voltage, and the second power source VSS provides a voltage of, for example, 0V, or a negative voltage.

When the OLED in FIG. 1 operates, there may be a large current. Once the anode and the cathode of the OLED are short-circuited, the current will flow directly from the driving transistor M2 to the second power source VSS, which may damage the pixel circuit.

Figure 2:
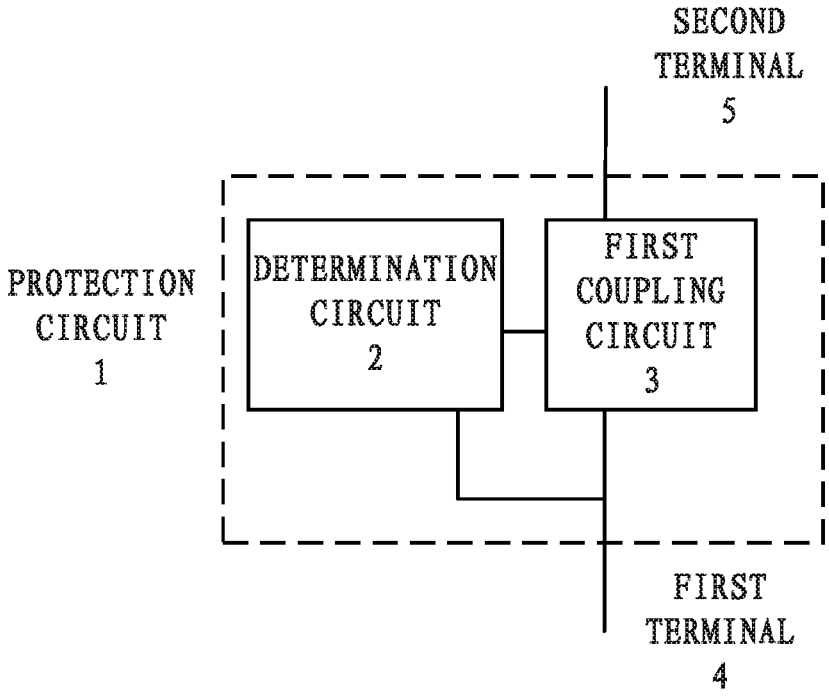
FIG. 2 is an exemplary block diagram of a protection circuit provided by embodiments of the present disclosure.

FIG. 2 is an exemplary block diagram of a protection circuit provided by embodiments of the present disclosure. As shown in FIG. 2, the protection circuit 1 includes a determination circuit 2, a first coupling circuit 3, a first terminal 4 and a second terminal 5. The determination circuit 2 is coupled to the first terminal 4 and the first coupling circuit 3, and is configured to determine whether the voltage at the first terminal 4 of the protection circuit 1 belongs to one of a first predetermined range and a second predetermined range. The first coupling circuit 3 is coupled to the first terminal 4, the second terminal 5 and the determination circuit 2, and is configured to: couple the first terminal 4 to the second terminal 5 in response to the voltage at the first terminal 4 belonging to the first predetermined range; and decoupled the first terminal 4 from the second terminal 5 in response to the voltage at the first terminal 4 belonging to the second predetermined range. As generally understood by those skilled in the art, "coupling" includes direct or indirect electrical connections.

The protection circuit 1 can be coupled in any current path in the pixel circuit shown in FIG. 1. The first predetermined range and the second predetermined range are set so that when the pixel circuit operates normally, the voltage at the first terminal 4 belongs to the first predetermined range, and when the pixel circuit cannot operate normally, the voltage at the first terminal 4 belongs to the second predetermined range. The determination circuit 2 can acquire the state of the voltage at the first terminal 4 so as to determine whether the pixel circuit operates normally, and then control the first coupling circuit 3 to couple the first terminal 4 to the second terminal 5 to maintain the current path in the pixel circuit, or, decouple the first terminal 4 from the second terminal 5 to disconnect the current path in the pixel circuit.

The protection circuit 1 has a compact structure, requires a small number of ports, and can be tightly integrated with existing pixel circuits. In addition, with the voltage as a detection object, the determination circuit 2 can perform a quick and accurate determination.

Figure 3:
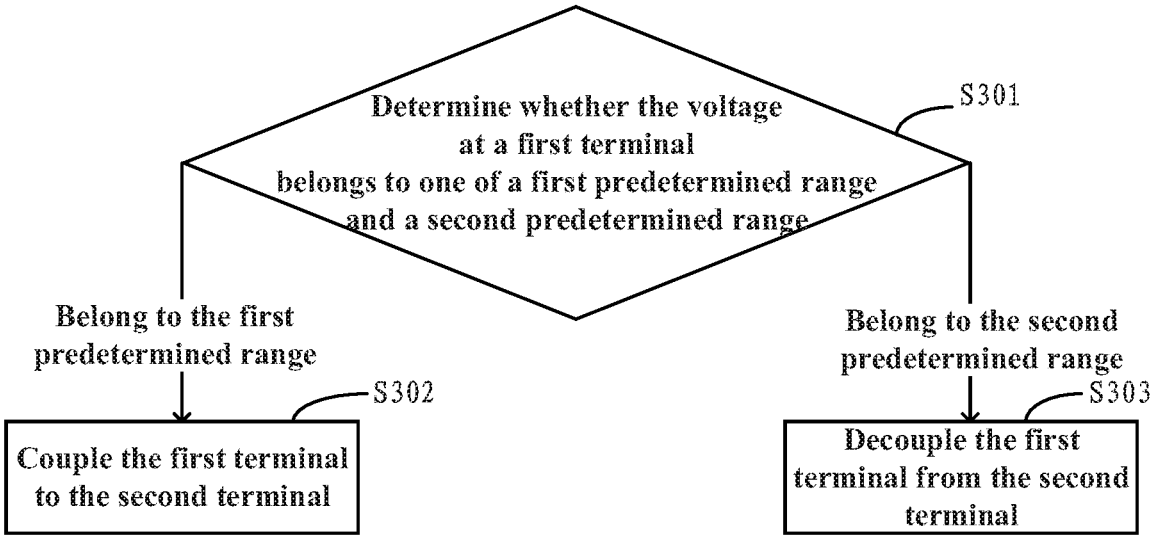
FIG. 3 is an exemplary flowchart of a protection method provided by embodiments of the present disclosure.

FIG. 3 is an exemplary flowchart of a protection method provided by embodiments of the present disclosure. The driving method of the pixel circuit includes: step S301, determining whether the voltage at the first terminal 4 of the protection circuit belongs to one of the first predetermined range and the second predetermined range; step S302, coupling the first terminal 4 to the second terminal 5 in response to the voltage at the first terminal 4 belonging to the first predetermined range; and step S303, decoupling the first terminal 4 from the second terminal 5 in response to the voltage at the first terminal 4 belonging to the second predetermined range.

The protection method provided by the embodiment of the present disclosure does not affect the existing driving manner of the pixel circuit and does not affect the normal operation of the pixel circuit. When the pixel circuit fails, the current path in the pixel circuit can be quickly and accurately cut off.

Figure 4:
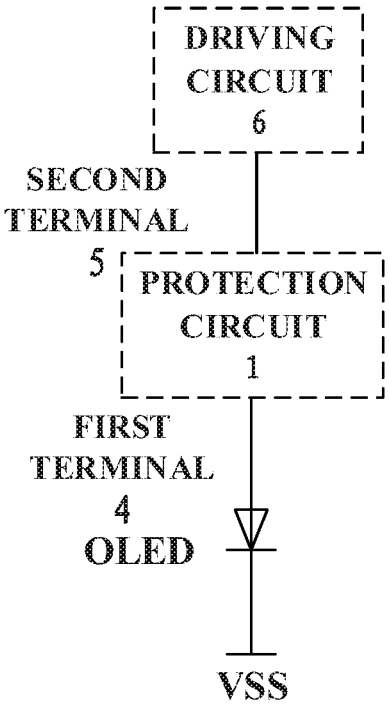
FIG. 4 is a schematic diagram of the protection circuit shown in FIG. 2 provided in a pixel circuit.

FIG. 4 is a schematic diagram of the protection circuit shown in FIG. 2 provided in a pixel circuit. As shown in FIG. 3, the protection circuit 1 is provided between the OLED and the driving circuit 6 of the OLED. Referring to FIG. 1, the protection circuit 1 can be provided between the OLED and the driving transistor M2. The first terminal 4 of the protection circuit 1 is coupled to the anode of the OLED, and the second terminal 5 of the protection circuit 1 is coupled to the driving transistor M2. The protection circuit 1 is configured to decouple the driving transistor M2 from the OLED when an abnormality occurs in the voltage of the anode of the OLED.

The protection circuit 1 shown in FIG. 4 can well respond to the abnormality of the voltage of the anode of the OLED, especially when the anode and the cathode of the OLED are short-circuited. It can be configured that the first predetermined range includes a voltage greater than a first voltage, and the second predetermined range includes a voltage less than a second voltage. That is, when the voltage of the anode of the OLED is greater than the first voltage, the OLED is considered to be in a normal state, and the coupling between the anode of the OLED and the driving transistor M2 is maintained. When the voltage of the anode of the OLED is less than the second voltage, the OLED is considered to be in an abnormal state so that the anode of the OLED is decoupled from the driving transistor M2. The first voltage can be the minimum value of the anode voltage when the OLED is operating normally, or a smaller value. The second voltage can be any value that is less than or equal to the first voltage.

For example, the second power source VSS provides a negative voltage as an example. When the anode and the cathode of the OLED are short-circuited, the anode voltage of the OLED will become a negative value. Therefore, both the first voltage and the second voltage can be set to 0V. That is, when the voltage of the anode of the OLED is greater than 0V, the OLED is considered to be in a normal state, and the coupling between the anode of the OLED and the driving transistor M2 is maintained. When the voltage of the anode of the OLED is less than 0V, the OLED is considered to be in an abnormal state so that the anode of the OLED is decoupled from the driving transistor M2.

At this time, it can be understood that the first predetermined range corresponds to the case where the anode and the cathode of the OLED are not short-circuited, and the second predetermined range corresponds to the case where the anode and the cathode of the OLED are short-circuited.

Of course, the first voltage can also be set to any positive value from 0V to the minimum value of the anode voltage during normal operation of the OLED. The second voltage can also be set to any negative value from 0V to the negative voltage provided by the second power source VSS.

It should be understood that in the foregoing description, the first predetermined range and the second predetermined range have been illustrated by way of example; however, these are not limitations of the present disclosure. When the anode voltage of the OLED is greater than the voltage of the second power source VSS and less than the voltage of the first power source VDD minus the voltage drop of the driving circuit 6, it can be considered that there is no short circuit. Both the first predetermined range and the first voltage can be set correspondingly with reference to this principle. For example, according to such a principle, the first voltage can be selected from the range of more than −1V and less than 5V, and further the first predetermined range can be set. For example, the first voltage can also be, for example, −1V. Correspondingly, the second voltage can also be −1V.

Figure 5:
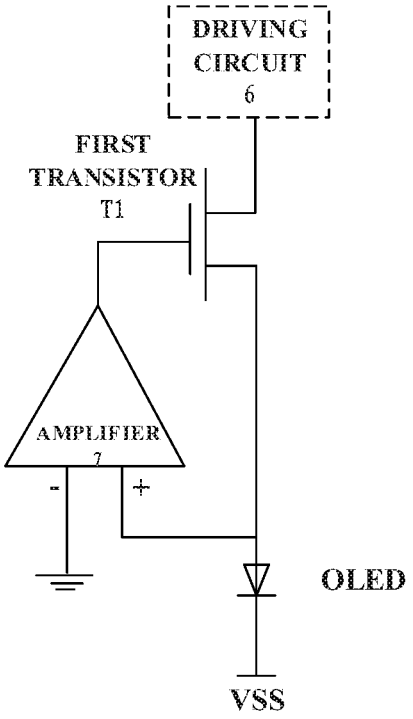
FIG. 5 is an exemplary circuit diagram of the protection circuit in FIG. 2.

FIG. 5 is an exemplary circuit diagram of the protection circuit in FIG. 2. As shown in FIG. 5, the determination circuit 2 includes an amplifier 7. The amplifier 7 includes a first input terminal, a second input terminal and an output terminal. The first input terminal of the amplifier 7 is coupled to the first terminal 4 of the protection circuit 1, i.e. the anode of the OLED. The second input terminal of the amplifier 7 is coupled to the reference voltage terminal. The output terminal of the amplifier 7 is coupled to the first coupling circuit 3.

The first coupling circuit 3 includes a first transistor T1. The control electrode of the first transistor T1 is coupled to the determination circuit 2. The first electrode of the first transistor T1 is coupled to the first terminal 4 of the protection circuit 1, i.e., the anode of the OLED. The second electrode of the first transistor T1 is coupled to the second terminal 5 of the protection circuit 1, i.e., the driving circuit 6.

As an example, the first input terminal of the amplifier 7 is a plus input terminal and the second input is a minus input terminal. The first transistor is an N-type transistor. Here, the reference voltage is set to a ground voltage of 0V.

In addition, the amplification characteristics of the amplifier 7 can be configured to be linear or non-linear. For example, the amplifier 7 can be configured to operate as a non-linear voltage comparator. At this time, when the voltage of the anode of the OLED is greater than 0V, the output terminal of the amplifier 7 outputs a predetermined positive voltage, so that the first transistor T1 is turned on to couple the driving circuit 6 to the anode of OLED. When the voltage of the anode of the OLED is less than 0V, the output terminal of the amplifier 7 outputs a predetermined 0V voltage or a negative voltage, so that the first transistor T1 is turned off to decouple the driving circuit 6 from the anode of the OLED.

As another example, the first input terminal is a minus input terminal, the second input terminal is a plus input terminal, and the first transistor is a P-type transistor. When the voltage of the anode of the OLED is greater than 0V, the output terminal of the amplifier 7 outputs a predetermined negative voltage so that the first transistor T1 is turned on. When the voltage of the anode of the OLED is less than 0V, the output terminal of the amplifier 7 outputs a predetermined positive voltage, so that the first transistor T1 is turned off. This can also achieve the same function.

In the circuit depicted in FIG. 4, the first voltage is set equal to the second voltage. Thus, one amplifier 7 can be used to implement the determination circuit 2.

The amplifier 7 can be realized by a thin film transistor, which is advantageous for wide application in pixel circuits. In addition, the amplifier 7 composed of thin film transistors can be uniformly manufactured in the manufacturing process of the array substrate where the pixel circuits are located, and the number of the manufacturing steps can be reduced. For example, a thin film transistor of a silicon substrate manufactured based on a semiconductor process can be selected to conveniently form a PMOS thin film transistor or an NMOS thin film transistor, providing higher accuracy and more stable performance, and facilitating the miniaturization of pixels. It should be understood that, on the premise of realizing the amplification function, the amplifier 7 can adopt any circuit structure, which is not limited herein.

Figure 6:
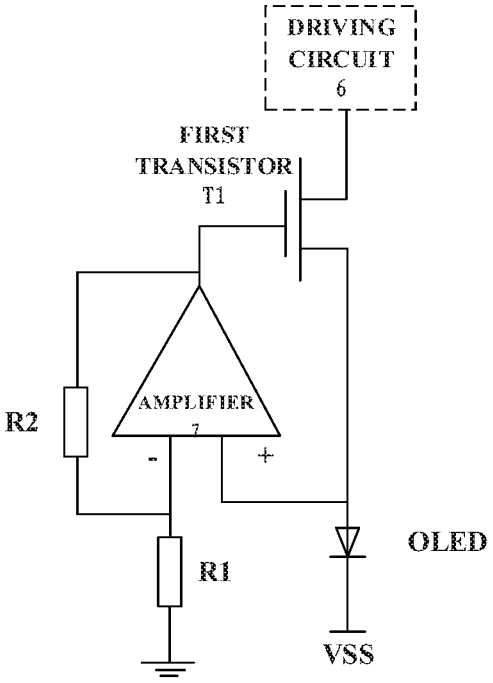
FIG. 6 is another exemplary circuit diagram of the protection circuit in FIG. 2.

FIG. 6 is another exemplary circuit diagram of the protection circuit in FIG. 2. As shown in FIG. 6, the second input terminal of the amplifier 7 is coupled to the reference voltage terminal through a first resistor RE The second input terminal of the amplifier 7 is coupled to the output terminal of the amplifier 7 through a second resistor R2. With such a configuration, the amplifier 7 has linear amplification characteristics. The voltage Vo at the output terminal of the amplifier 7 is Vo=(R2/R1+1) Vin, where R1 represents the resistance of the first resistor R1, R2 represents the resistance of the second resistor R2, and Vin represents the voltage of the first input terminal. With such a configuration, once a short circuit occurs between the anode and the cathode of the OLED, the voltage Vin at the first input terminal will be equal to the voltage Vvss at the second power source VSS. The voltage at the output terminal of the amplifier 7 can be Vo=(R2/R1+1)Vvss. Taking Vvss as a negative value, for example, a large negative voltage will be applied to the control electrode of the first transistor T1 so that the first transistor T1 will quickly enter an off state, which is particularly suitable when it is desired to rapidly and stably cut the short circuit.

It should be understood that the amplification characteristics of the amplifier 7 can also be adjusted by more resistors.

The first resistor R1 and the second resistor R2 can be realized by a thin film resistor, which is advantageous for wide application in pixel circuits.

Figure 7:
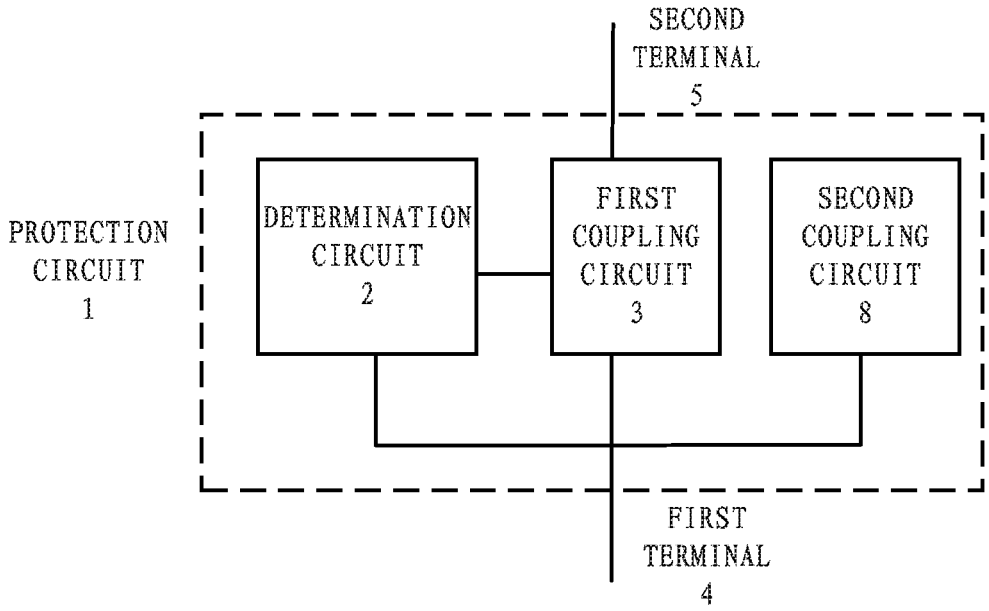
FIG. 7 is another exemplary block diagram of a protection circuit provided by embodiments of the present disclosure.

FIG. 7 is another exemplary block diagram of a protection circuit provided by embodiments of the present disclosure. As shown in FIG. 7, the protection circuit 1 further includes a second coupling circuit 8. The second coupling circuit 8 is connected to the first terminal 4 of the protection circuit 1, and is configured such that the voltage at the first terminal 4 of the protection circuit 1 belongs to the first predetermined range.

Referring to the specific circuit structures in FIG. 5 and FIG. 6, the reference voltage is set to 0V in order to enable the protection circuit 1 to quickly respond to the short-circuited state. Once the voltage of the anode of the OLED is negative, the first transistor T1 is turned off. In the normal state, the voltage of the anode of the OLED can also be maintained at 0V always. The voltage of 0 V also cannot turn on the first transistor T1 or enable the first transistor T1 to be turned on stably, which is disadvantageous to the driving of the OLED.

The second coupling circuit 8 can make, at a predetermined time, the voltage at the first terminal 4 of the protection circuit 1 belong to the first predetermined range. As such, the first coupling circuit 3 will couple the driving circuit 6 to the OLED, and the OLED can operate, driven by the driving circuit 6. Thereafter, the driving circuit 6 can provide a positive voltage for the anode of the OLED, and the first coupling circuit 3 will remain on until the driving of the OLED is completed or a short circuit or the like occurs.

The second coupling circuit 8 can be implemented in various ways. For example, the first terminal 4 of the protection circuit 1 can be directly coupled to a signal source through a signal line, and a positive pulse signal can be applied to the first terminal 4 of the protection circuit 1 at a predetermined time.

Figure 8:
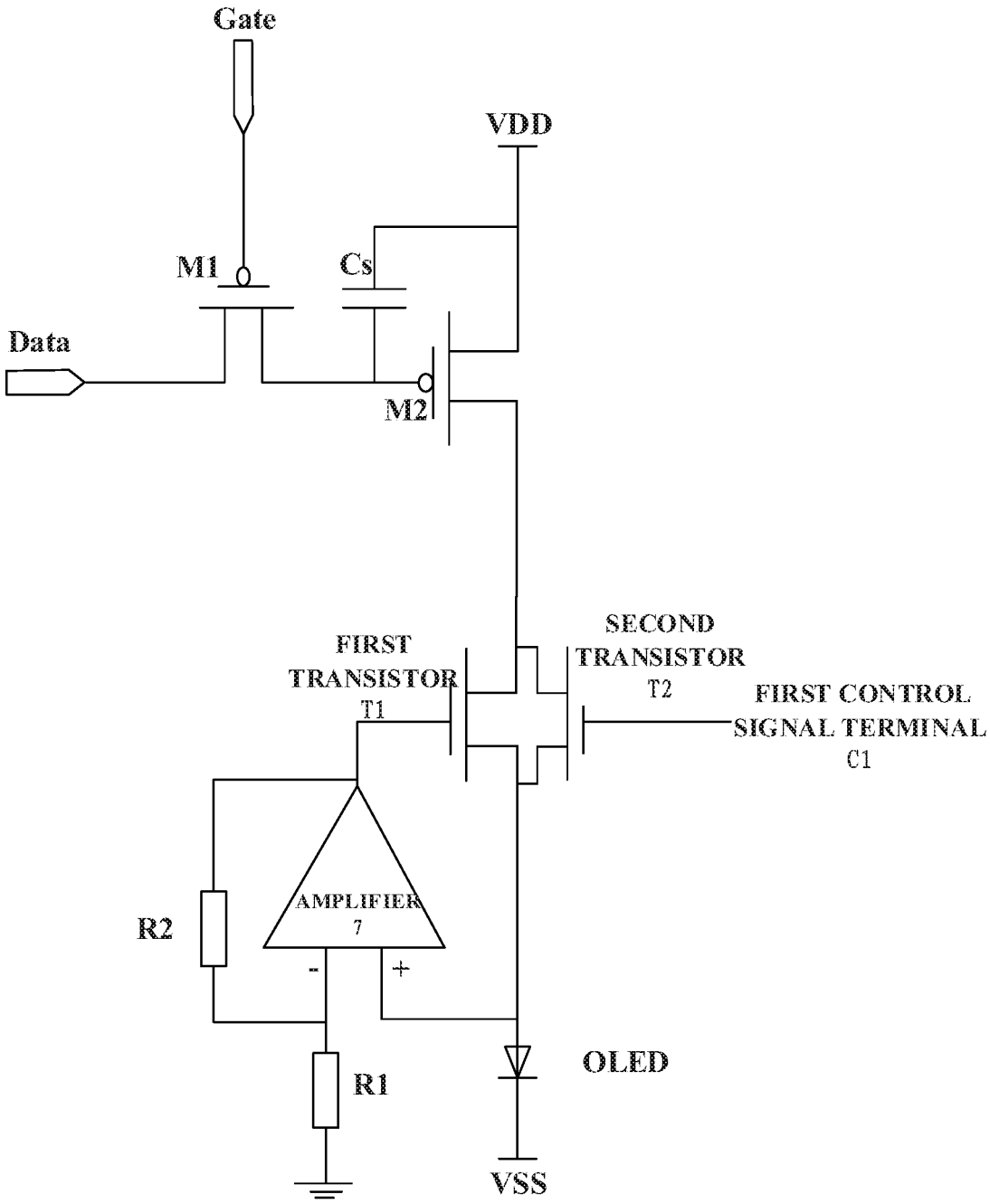
FIG. 8 is an exemplary circuit diagram of a pixel circuit including the protection circuit in FIG. 7.

FIG. 8 is an exemplary circuit diagram of a pixel circuit including the protection circuit in FIG. 7. As shown in FIG. 8, the second coupling circuit 8 includes a second transistor T2. The control electrode of the second transistor T2 is coupled to a first control signal terminal C1. The first electrode of the second transistor T2 is coupled to the anode of the OLED (i.e., the first terminal 4 of the protection circuit 1). The second electrode of the second transistor T2 is coupled to the driving transistor M2 (i.e., the second terminal 5 of the protection circuit 1).

According to the circuit shown in FIG. 8, a control signal from the first control signal terminal C1 can turn on the second transistor T2. When the second transistor T2 is turned on, as long as the voltage stored in the storage capacitor Cs causes the driving transistor M2 to operate to generate a driving current, the voltage of the anode of the OLED becomes a positive voltage. That is, the second coupling circuit 8 utilizes the driving transistor M2 to cause the voltage of the anode of the OLED (i.e., the first terminal 4 of the protection circuit 1) to fall within the first predetermined range. After that, the first transistor T1 is also turned on. Thereafter, even if the second transistor T2 is turned off, the first transistor T1 can maintain a turned-on state until the voltage of the anode of the OLED becomes 0V or a negative voltage due to completion of the driving or short-circuiting of the OLED.

Figure 9:
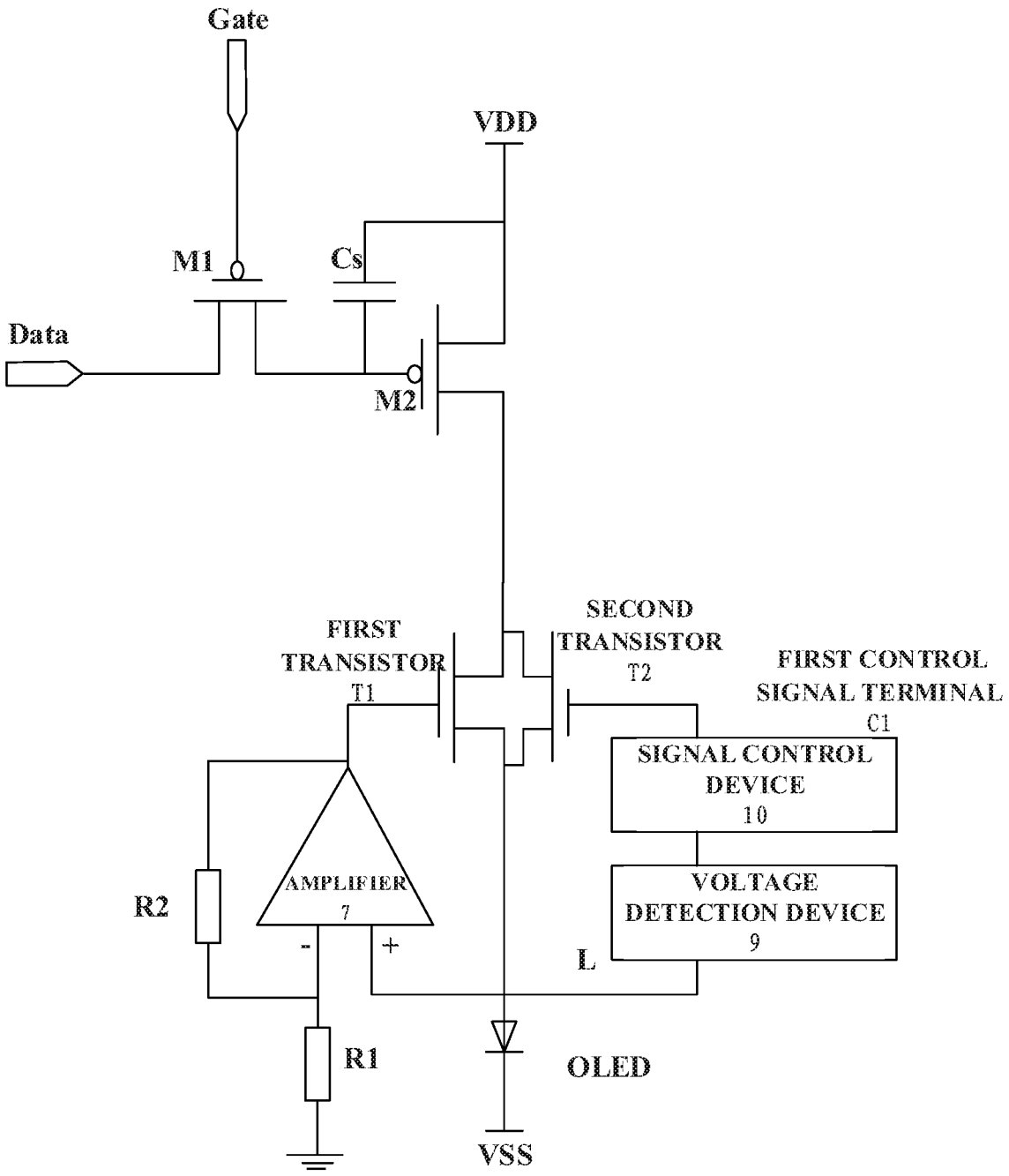
FIG. 9 is another exemplary circuit diagram of a pixel circuit including the protection circuit in FIG. 7.

FIG. 9 is another exemplary circuit diagram of a pixel circuit including the protection circuit in FIG. 7. The protection circuit 1 further includes a voltage detection line L. The voltage detection line L is configured to couple the first terminal 4 of the protection circuit 1 to the voltage detection device 9. The second transistor T2 is configured to be turned on in response to the voltage at the first terminal 4 of the protection circuit 1 belonging to a third predetermined range.

As described above, the control signal from the first control signal terminal C1 can cause the second transistor T2 to be turned on. When the second transistor T2 is turned on, as long as the voltage stored in the storage capacitor Cs causes the driving transistor M2 to operate to generate a driving current, the voltage of the anode of the OLED becomes a positive voltage, so that the first transistor T1 is also turned on. However, in the case where the OLED has been short-circuited, if the second transistor T2 is directly turned on, an excessive current may be generated instantaneously, to damage the pixel circuit. The voltage detection line L couples the first terminal 4 of the protection circuit 1 (i.e., the anode of the OLED) to the voltage detection device 9. The voltage detection device 9 detects the voltage of the anode of the OLED, and sends it to a signal control device 10 to determine whether it belongs to a third predetermined range. The third predetermined range can be a range of voltages representing the anode and the cathode of the OLED are not short-circuited. In general, the voltage of the anode of the OLED is 0V, without being driven. In consideration of other reasonable changes such as noise, the third predetermined range can be a relatively small range including 0V. The third predetermined range can be determined by means of such as experiments or the like according to the actual application environment. In addition, the third predetermined range can also be set in consideration of the situation when the OLED is driven. For example, the third predetermined range can be a range greater than −1V and less than 5V.

The signal control device 10 turns on the second transistor T2 when it is determined that the voltage of the anode of the OLED falls within the third predetermined range. In this way, the application of a driving voltage to the OLED can be prevented in the case where the anode and the cathode of the OLED have been short-circuited.

In addition, as one example, the voltage detection device 9 and the signal control device 10 can be integrated in a scan driving circuit of a pixel circuit, and can also be separately provided.

Figure 10:
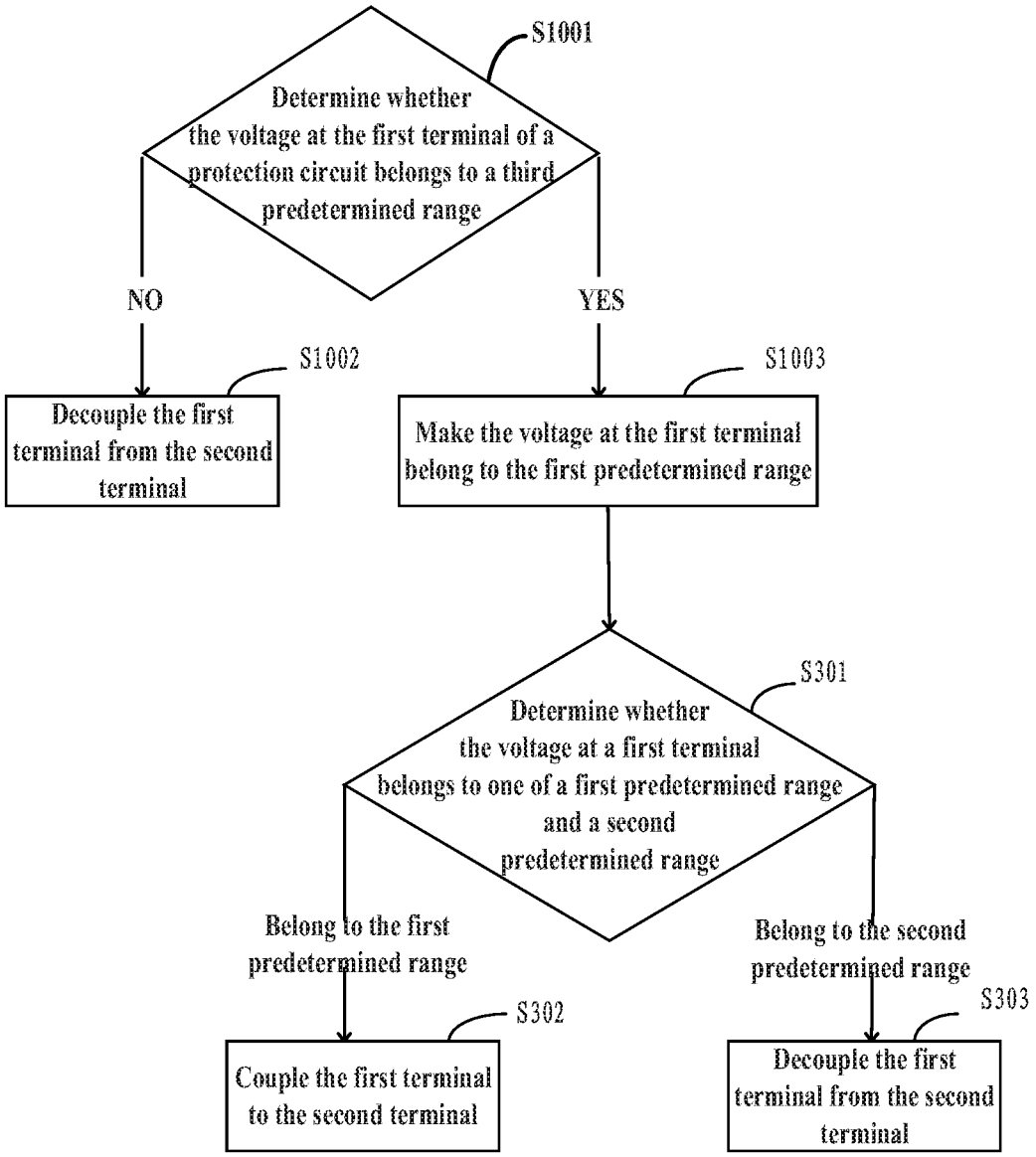
FIG. 10 is an exemplary flowchart of a driving method of the pixel circuit shown in FIG. 9.

FIG. 10 is an exemplary flowchart of a driving method of the pixel circuit shown in FIG. 9. As shown in FIG. 10, in step S1001 of the driving method, it is determined whether the voltage of the anode of the OLED (the first terminal 4 of the protection circuit 1) belongs to the third predetermined range.

In step S1002, the second transistor T2 is turned off in response to the voltage of the anode of the OLED not belonging to the third predetermined range, so as to decouple the anode of the OLED from the driving transistor M2 (i.e., the coupling between the first terminal 4 and the second terminal 5 of the protection circuit 1).

In step S1003, the second transistor T2 is turned on in response to the voltage of the anode of the OLED belonging to the third predetermined range. The second transistor T2 can remain on for a predetermined period of time. When the second transistor T2 is turned on, the driving transistor M2 is coupled to the OLED. At the time, as long as the voltage stored in the storage capacitor Cs enables the driving transistor M2 to be turned on, the driving transistor M2 generates a driving current. The driving current reaches the anode of the OLED so that the OLED emits light, and the voltage of the anode rises to fall within the first predetermined range.

It should be understood that the circuit shown in FIG. 9 is used as an example to illustrate the method of causing the first terminal 4 of the protection circuit 1 to fall within the first predetermined range. However, this is not a limitation of the present disclosure. For example, the first terminal 4 can be directly connected to other signal sources or power sources such that the voltage at the first terminal 4 of the protection circuit 1 falls within the first predetermined range, thereby turning on the first transistor T1.

In addition, the protection circuit 1 also continues to perform the steps shown in FIG. 3. In step S301, it is determined whether the voltage at the first terminal 4 of the protection circuit belongs to one of the first predetermined range and the second predetermined range. In step S302, the first terminal 4 is coupled to the second terminal 5 in response to the voltage at the first terminal 4 belonging to the first predetermined range. In step S303, the first terminal 4 is decoupled from the second terminal 5 in response to the voltage at the first terminal 4 belonging to the second predetermined range.

That is, even if the second transistor T2 in the second coupling circuit 8 is turned off, the protection circuit 1 still can maintain the coupling between the driving transistor M2 and the OLED until the voltage of the anode of the OLED becomes 0V or a negative voltage due to completion of the driving or short-circuiting of the OLED.

It is determined whether the voltage of the anode of the OLED (the first terminal 4 of the protection circuit 1) belongs to the third predetermined range, and then the second transistor T2 is turned on or turned off. This can prevent the application of a driving current to the OLED in the case where the OLED has been short-circuited, preventing damage that may be caused by an excessive transient circuit.

Figure 11:
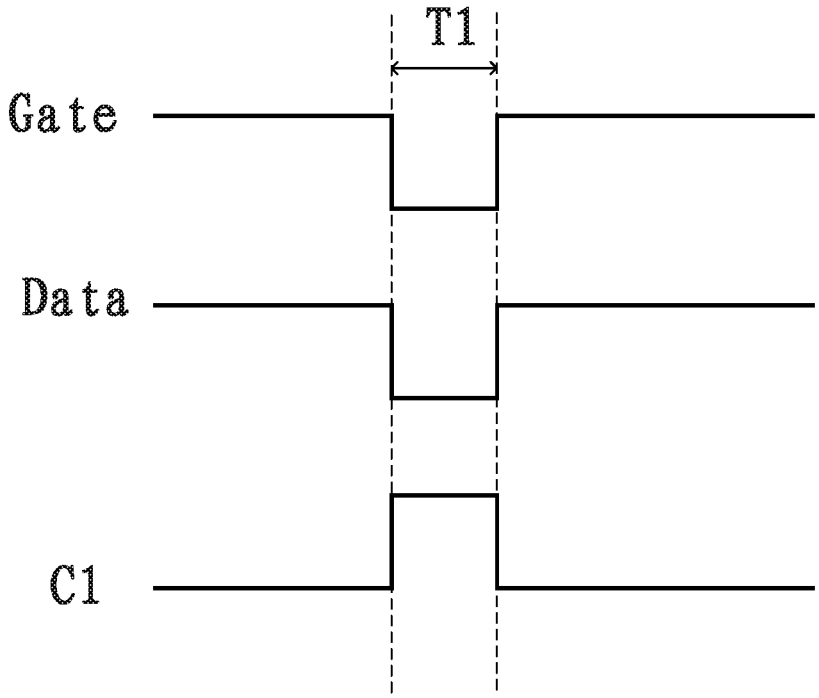
FIG. 11 is an exemplary timing diagram of the circuit shown in FIG. 8 or FIG. 9.

FIG. 11 is an exemplary timing diagram of the circuit shown in FIG. 8 or FIG. 9. As shown in FIG. 8, in the first phase T1, the voltage on the scan line Gate is a valid voltage, so that the switching transistor M1 is turned on. Here, the switching transistor M1 is a P-type transistor as an example, and therefore the valid voltage on the scan line Gate is a low-level voltage. After the switching transistor M1 is turned on, the valid voltage on the data line Data is stored in the storage capacitor Cs for subsequently driving the driving transistor M2. Here, the driving transistor M2 is a P-type transistor as an example, and therefore, the valid voltage on the data line Data is a low-level voltage.

In addition, in the first phase T1, the second transistor T2 is turned on by a valid voltage from the first control terminal C1. Because, in the first phase T1, the voltage stored in the storage capacitor Cs can cause the driving transistor M2 to operate to generate a driving current. The voltage of the anode of the OLED is a positive voltage, which turns on the first transistor T1. The state in which the first transistor T1 is turned on is maintained until the driving for the OLED or the occurrence of a short circuit or the like is completed so that the voltage of the anode of the OLED becomes 0V or a negative voltage due to completion of the driving or short-circuiting of the OLED.

Here, the second transistor T2 is an N-type transistor as an example, and therefore, the valid voltage from the first control terminal C1 shown in FIG. 9 is a high-level voltage.

For convenience of explanation, it is shown in FIG. 11 that the start time and the duration of the valid voltage from the first control terminal C1 are the same as those of the valid voltages on the scan line Gate and the data line Data. However, it should be understood that this is not a limitation on the embodiments of the present disclosure. As the voltage on the data line Data can be stored in the storage capacitor Cs for a period of time, so long as the second switch transistor T2 is turned on during the first phase T1 or within a period of time after the first phase T1, the same effect can be achieved. That is, the second transistor T2 can also function to control the start time of the light emission phase of the pixel circuit.

As an example not illustrated, the second switching transistor T2 can be turned on after the first phase T1 is completed and the voltage stored in the storage capacitor Cs is stabilized, so that the driving transistor M2 can generate a stable driving current. In this way, the OLED can maintain a stable luminance.

With reference to the timing diagram shown in FIG. 11, it can further be understood that the protection circuit and the protection method provided by the embodiments of the present disclosure can quickly and accurately cut off the current path in the pixel circuit when the pixel circuit fails, without influencing the existing circuit structure and the driving method of the pixel circuit.

It should be understood that the application of the protection circuit 1 is not limited thereto. For example, the protection circuit 1 can also be provided between the storage capacitor Cs and the control electrode of the driving transistor M2. The first predetermined range of the voltage of the control electrode of the driving transistor M2 can be a range of the data voltage, and the second predetermined range can be a range other than the data voltage. If the two electrode plates of the storage capacitor Cs are short-circuited, the determination circuit 2 may detect that the voltage of the control electrode of the drive transistor M2 is equal to the voltage of the positive power source VDD, which is usually greater than the maximum value of the data voltage, and thus falls within the second predetermined range. At the time, the protection circuit 1 can decouple the driving transistor M2 from the storage capacitor Cs to protect the pixel circuit.

In addition, although the structure of the pixel circuit shown in FIG. 1 is described as an example, this is not a limitation of the present disclosure, and the protection circuit in the embodiment of the present disclosure can be applied to any pixel circuit structure.

Further provided in the embodiments of the present disclosure is a display device, including the above-described pixel circuit. The display device can specifically be a product or component having any display function such as a display, a television, an electronic paper, a mobile phone, a tablet computer, and a digital photo frame.

The foregoing descriptions are merely specific implementation modes of the present disclosure. However, the scope of protection of the present disclosure is not limited thereto. Any changes or substitutions that can be easily conceived by those skilled in the art within the technical scope disclosed by the present disclosure should be encompassed within the scope of protection of the present disclosure. Therefore, the protection scope of the present disclosure should be based on the protection scope of the accompanying claims.

What is claimed is:

1. A protection circuit, comprising: a determination circuit, a first coupling circuit, a first terminal, a second terminal and a second coupling circuit;

the determination circuit is coupled to the first terminal and the first coupling circuit, and is configured to determine whether a voltage at the first terminal of the protection circuit belongs to one of a first predetermined range and a second predetermined range;

the first coupling circuit is coupled to the first terminal, the second terminal and the determination circuit, and is configured to:

couple the first terminal to the second terminal in response to the voltage at the first terminal belonging to the first predetermined range; and decouple the first terminal from the second terminal in response to the voltage at the first terminal belonging to the second predetermined range;

the second coupling circuit is connected to the first terminal of the protection circuit and configured to make the voltage at the first terminal of the protection circuit belong to the first predetermined range;

wherein the second coupling circuit comprises a second transistor; and wherein a control electrode of the second transistor is coupled to a first control signal terminal, a first electrode of the second transistor is coupled to the first terminal of the protection circuit, and a second electrode of the second transistor is coupled to the second terminal of the protection circuit;

wherein the protection circuit further comprises a voltage detection line;

wherein the voltage detection line is configured to couple the first terminal of the protection circuit to a voltage detection device; and wherein the second transistor is configured to be turned on in response to the voltage at the first terminal of the protection circuit belonging to a third predetermined range.

2. The protection circuit according to claim 1, wherein the determination circuit comprises an amplifier comprising a first input terminal, a second input terminal and an output terminal;

wherein the first input terminal of the amplifier is coupled to the first terminal of the protection circuit;

wherein the second input terminal of the amplifier is coupled to a reference voltage terminal; and wherein the output terminal of the amplifier is coupled to the first coupling circuit.

3. The protection circuit according to claim 2, wherein the second input terminal of the amplifier is coupled to the reference voltage terminal through a first resistor; and wherein the second input terminal of the amplifier is coupled to the output terminal of the amplifier through a second resistor.

4. The protection circuit according to claim 3, wherein the first coupling circuit comprises a first transistor, and wherein a control electrode of the first transistor is coupled to the determination circuit, a first electrode of the first transistor is coupled to the first terminal of the protection circuit, and a second electrode of the first transistor is coupled to the second terminal of the protection circuit.

5. The protection circuit according to claim 3, wherein the voltage in the first predetermined range is greater than a first voltage; and wherein the voltage in the second predetermined range is less than a second voltage.

6. The protection circuit according to claim 2, wherein the first coupling circuit comprises a first transistor, and wherein a control electrode of the first transistor is coupled to the determination circuit, a first electrode of the first transistor is coupled to the first terminal of the protection circuit, and a second electrode of the first transistor is coupled to the second terminal of the protection circuit.

7. The protection circuit according to claim 2, wherein the voltage in the first predetermined range is greater than a first voltage; and wherein the voltage in the second predetermined range is less than a second voltage.

8. The protection circuit according to claim 1, wherein the first coupling circuit comprises a first transistor, and wherein a control electrode of the first transistor is coupled to the determination circuit, a first electrode of the first transistor is coupled to the first terminal of the protection circuit, and a second electrode of the first transistor is coupled to the second terminal of the protection circuit.

9. The protection circuit according to claim 1, wherein the voltage in the first predetermined range is greater than a first voltage; and wherein the voltage in the second predetermined range is less than a second voltage.

10. The protection circuit according to claim 9, wherein the first voltage is equal to the second voltage.

11. A protection method, performed by the protection circuit according to claim 1, the protection method comprising:

determining whether the voltage at a first terminal belongs to one of a first predetermined range and a second predetermined range;

coupling the first terminal to the second terminal in response to the voltage at the first terminal belonging to the first predetermined range; and decoupling the first terminal from the second terminal in response to the voltage at the first terminal belonging to the second predetermined range.

12. The protection method according to claim 11, further comprising:

determining whether the voltage at the first terminal belongs to a third predetermined range; and in response to the voltage at the first terminal belonging to the third predetermined range, making the voltage at the first terminal belong to the first predetermined range.

13. A pixel circuit, comprising the protection circuit according to claim 1.

14. The pixel circuit according to claim 13, wherein the first terminal of the protection circuit is connected to a light emitting device in the pixel circuit; and wherein the second terminal of the protection circuit is connected to the driving circuit in the pixel circuit.

15. A display device, comprising the pixel circuit according to claim 13.

* * * * *